US012351963B1

(12) United States Patent
Hughes

(10) Patent No.: US 12,351,963 B1
(45) Date of Patent: Jul. 8, 2025

(54) MANUAL SEWING STITCH GUIDE TOOL AND METHOD OF USE THEREOF

(71) Applicant: Zachary Hughes, Pensacola, FL (US)

(72) Inventor: Zachary Hughes, Pensacola, FL (US)

( * ) Notice: Subject to any disclaimer, the term of this patent is extended or adjusted under 35 U.S.C. 154(b) by 0 days.

(21) Appl. No.: 18/769,073

(22) Filed: Jul. 10, 2024

(51) Int. Cl.
*D05B 91/06* (2006.01)

(52) U.S. Cl.
CPC ..... *D05B 91/06* (2013.01)

(58) Field of Classification Search
CPC ..... D05B 97/02; D05B 97/00; D05B 97/12; D05B 91/06; D05C 1/02; D05C 1/08; G09B 19/20
USPC ..... 112/136, 475.01
See application file for complete search history.

(56) References Cited

U.S. PATENT DOCUMENTS

| | | | | |
|---|---|---|---|---|
| 2,077,772 | A * | 4/1937 | Ring | A41H 3/06 33/13 |
| 2,574,064 | A | 11/1951 | Rosen | |
| 2,986,390 | A | 5/1961 | Kelly | |
| 3,749,038 | A | 7/1973 | Dodsworth | |
| 4,236,470 | A | 12/1980 | Stenson | |
| 4,530,665 | A | 7/1985 | Colonel | |
| 4,608,939 | A | 9/1986 | Lampley | |
| 4,682,551 | A | 7/1987 | Toman | |
| 5,261,340 | A | 11/1993 | Conley, Jr. et al. | |
| 5,694,871 | A | 12/1997 | Tippmann, Sr. | |
| 6,155,189 | A | 12/2000 | Walner | |
| 6,413,091 | B1 | 7/2002 | Fields | |
| 7,255,051 | B2 | 8/2007 | Graham et al. | |
| 8,074,384 | B2 * | 12/2011 | Kuwabara | D05C 1/02 38/102.2 |
| 8,156,877 | B1 | 4/2012 | Carr | |
| 8,186,073 | B2 * | 5/2012 | Nethery | B43L 7/005 33/562 |
| 8,261,680 | B2 | 9/2012 | Oe | |
| 8,397,396 | B2 * | 3/2013 | Nethery | B43L 7/027 33/566 |
| 11,807,967 | B2 | 11/2023 | Beyou et al. | |
| 2004/0172844 | A1 | 9/2004 | Murray et al. | |
| 2010/0018084 | A1 | 1/2010 | Segrete | |
| 2010/0038838 | A1 | 2/2010 | Gallo | |
| 2012/0145058 | A1 * | 6/2012 | Oe | D05B 97/02 112/475.01 |

(Continued)

OTHER PUBLICATIONS

Design U.S. Appl. No. 29/951,654, filed Jul. 10, 2024, to Zachary Hughes.

*Primary Examiner* — Danny Worrell
(74) *Attorney, Agent, or Firm* — AdamsIP, LLC; Stephen Thompson; J. Hunter Adams

(57) ABSTRACT

A stitch guide tool and a method of using the tool to manually sew a stitch are provided. The tool has two opposing plates that can be brought together with a piece of fabric to be stitched being positioned between the two plates. Each plate has a series of holes extending through the plate, and the holes in each plate align with each other so that a sewing needle can be passed through a pair of holes and the fabric positioned between the holes. Each series of holes is connected by a slot so that the thread can pass between adjacent holes through the slot. The needle can be passed back and forth through adjacent sets of holes consecutively to create a straight stitch in the fabric. The thread can be (Continued)

pulled through portions of the slot between holes to tighten the thread to the fabric to create the stitch.

19 Claims, 11 Drawing Sheets

(56) References Cited

U.S. PATENT DOCUMENTS

2017/0124913 A1 5/2017 Levin

* cited by examiner

MANUAL SEWING STITCH GUIDE TOOL AND METHOD OF USE THEREOF

FIELD OF THE DISCLOSURE

The subject matter of the present disclosure refers generally to a stitch guide tool and a method of using the tool to manually sew a stitch.

BACKGROUND

The art of sewing has been a part of human civilization for thousands of years, with the earliest known instances dating back to the Paleolithic era. Over time, the methods and tools used for sewing have evolved, from simple bone needles and animal sinew to modern sewing machines and synthetic threads. Despite these advancements, the basic concept of sewing remains essentially the same. A needle and thread are used to join two pieces of fabric or similar types of pliable material together.

Sewing is a means of not only creating clothing or similar items, but also a popular hobby and a valuable skill. For many people, the cost of new clothing is high and so they would like to be able to wear used clothing, whether donated, purchased from a used clothing store, or passed from one family member to another. However, such clothing is often not exactly the correct size and must be altered for a proper fit. Many alterations require changing the length of a pair of trousers or shorts or the length of a shirt sleeve. This is typically done by creating a hem stitch using some type of sewing device. However, having clothing professionally altered can be expensive, and sewing can be a complex and time-consuming task, particularly for beginners or those with limited experience. One of the challenges faced by novice sewers is the difficulty in creating consistent, evenly spaced stitches. This is especially true for hand sewing, which requires a high degree of precision and control.

Various tools and devices have been developed to assist with sewing, ranging from simple thimbles and seam rippers to complex sewing machines. Modern sewing machines are generally efficient and capable of producing high-quality stitches, but they can be expensive and also require a power source to operate. They can also be dangerous to operate and require a certain level of skill, which can be intimidating for beginners due to their complexity and the potential for injury if used incorrectly. Handheld sewing devices offer a more portable and accessible alternative to sewing machines, but these often produce inconsistent stitches, still require a power source, and also require a level of skill in order to use properly. Other solutions, such as iron-on tapes, can be used to create the illusion of a hem, but these can be problematic as they may lose contact with the fabric over time, particularly when exposed to high heat, such as in a clothing dryer.

Given these challenges, there is a need in the art for a simple, affordable, and effective tool that can assist individuals in creating consistent, evenly spaced stitches by hand. Such a tool would be particularly beneficial for those who lack sewing skills or experience, or for those who do not have access to a sewing machine. It would also be useful for quick repairs or alterations, such as hemming a pair of trousers or converting an old pair of trousers into shorts.

SUMMARY

In one aspect, a stitch guide tool and a method of using the tool to manually sew a stitch are provided. The tool is designed to allow a user to easily hand stitch a straight hemline on a pair of trousers or other article of clothing even if the user has minimal sewing skills. The tool comprises two opposing plates that can be brought together with a piece of fabric disposed between the two plates. Each plate has a series of horizontally aligned holes that are also vertically aligned with the holes in the opposing plate when the two plates are brought together. The user can insert a sewing needle with attached sewing thread through one set of vertically aligned holes, thereby also passing the needle and thread through the fabric. The user can then insert the needle and thread through an adjacent set of vertically aligned holes, thus passing the needle and thread through the fabric a second time. This process can be repeated using entrance holes on opposite sides of the device to create a stitch pattern in a straight line.

The first plate and the opposing second plate are configured to be retained in a generally fixed position relative to each other when the tool is being used for sewing. In a preferred embodiment, the tool comprises a hinge that attaches the two plates to each other so that the two plates pivot about the hinge relative to each other. The first plate has a first series of holes each extending through the first plate, and the second plate has a second series of holes extending through the second plate. The holes of the first series of holes are aligned along a first straight line, and the holes of the second series of holes are aligned along a second straight line. The first plate has a first slot extending through the first plate with the first slot being disposed along the first straight line along which the first series of holes is aligned so that the first slot connects each of the holes in the first series of holes. Likewise, the second plate has a second slot extending through the second plate with the second slot being disposed along the second straight line along which the second series of holes is aligned so that the second slot connects each of the holes in the second series of holes. When the two plates are brought together so that the plates are positioned adjacent to each other, each respective hole of the first series of holes is configured to longitudinally align with a corresponding hole of the second series of holes. When the plates are attached by a hinge, the tool is designed to that the two series of holes automatically align with each other when the plates are pivoted into a position in which the two plates are generally parallel to each other.

In a preferred embodiment, each of the holes in both the first and second series of holes is sized to allow the sewing needle to pass through the hole, but portions of each slot disposed between adjacent holes of each series of holes are sized so that the thread can pass between those portions of the slot but the sewing needle cannot pass through those portions. This allows for accurate positioning of the needle while allowing the thread to be pulled tightly through the slot and to the fabric between stitches. In another preferred embodiment, the holes in each series of holes alternate between holes of a first diameter and holes of a second diameter that is larger than the first diameter, and holes of the first diameter in one series of holes align with holes of the second diameter in the opposing series of holes. This allows an entrance hole for the needle on one side of the tool to be relatively small and an exit hole for the needle on the opposite side of the tool to be relatively large, which provides for accurate stitching but also provides an allowance of space for the needle to enter the exit hole if the holes are not perfectly aligned.

The foregoing summary has outlined some features of the system and method of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purpose of the system and method disclosed herein. Those skilled in the pertinent art should also realize that such equivalent designs or modifications do not depart from the scope of the system and method of the present disclosure.

DESCRIPTION OF THE DRAWINGS

These and other features, aspects, and advantages of the present disclosure will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, steps, etc. are optionally present. For example, a system "comprising" components A, B, and C can contain only components A, B, and C, or can contain not only components A, B, and C, but also one or more other components. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 13:
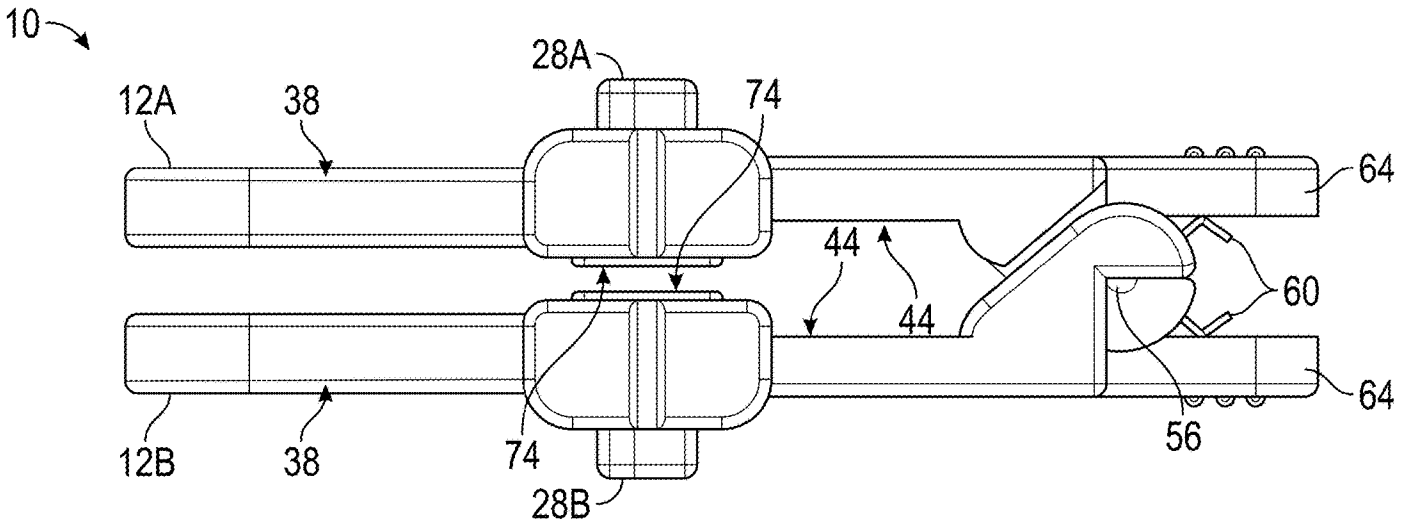
FIG. 13 shows a side elevation view of a stitch guide tool in accordance with the present disclosure.
Figure 14:
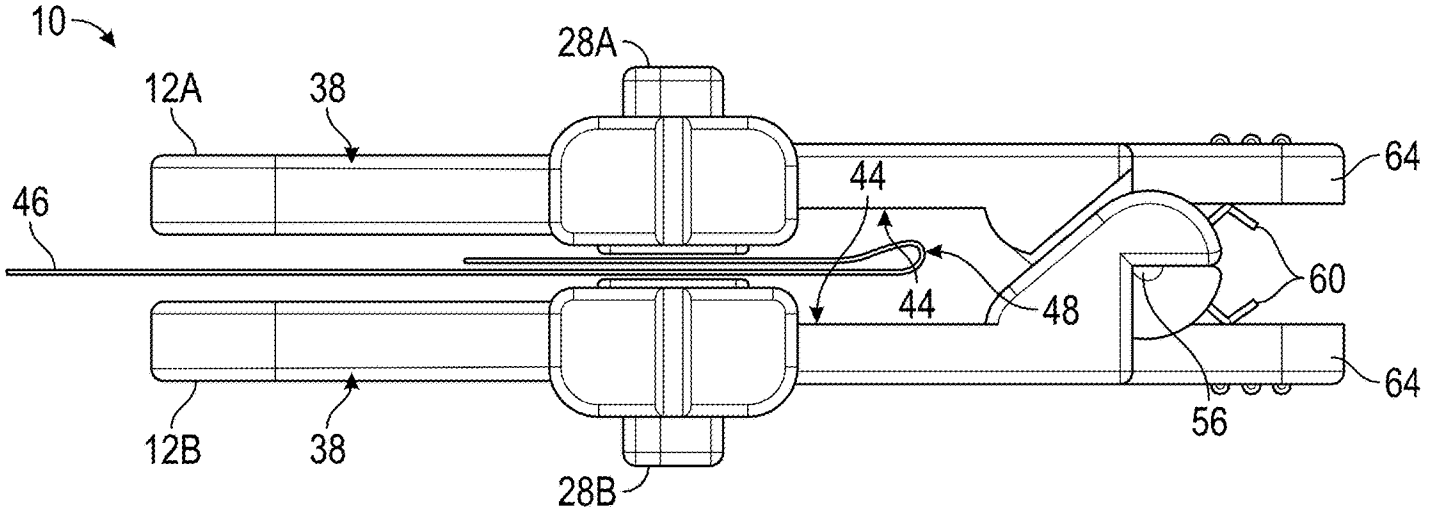
FIG. 14 shows a side elevation view of a stitch guide tool being used with a piece of fabric in accordance with the present disclosure.
Figure 15:
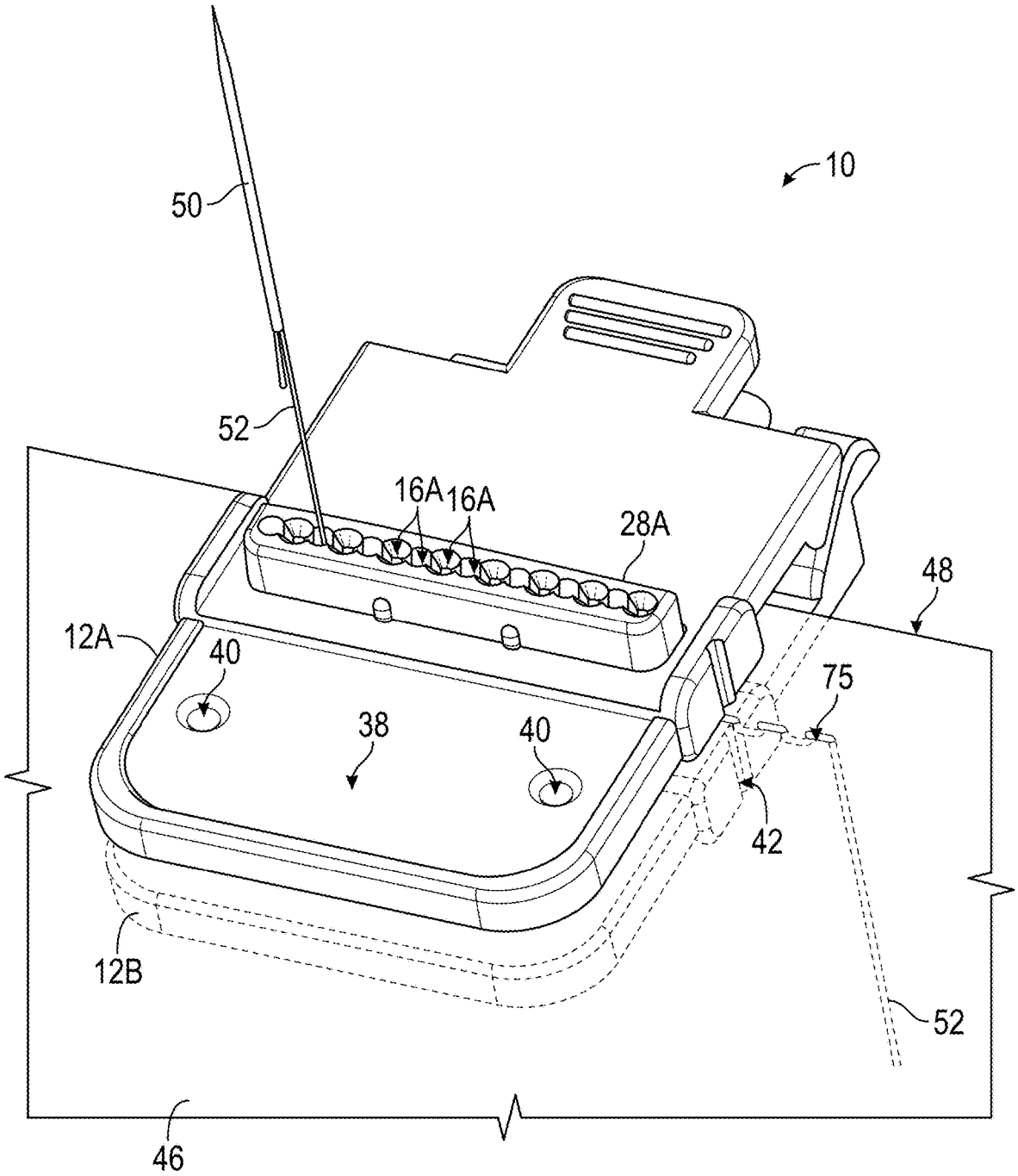
FIG. 15 shows a perspective view of a stitch guide tool being used with a piece of fabric in accordance with the present disclosure.

In one aspect, a stitch guide tool 10 and a method of using the tool 10 to manually sew a stitch 75 are provided. The tool 10 is designed to allow a user to manually stitch a straight hemline on any article of clothing, such as a pair of trousers or a shirt. FIGS. 1-13 illustrate a preferred embodiment of the tool 10 or components thereof. FIGS. 14 and 15 illustrate the tool 10 being used with a sewing needle 50 and a length of sewing thread 52 attached to the needle 50 to sew a stitch 75 on a piece of folded fabric 46.

Figure 10:
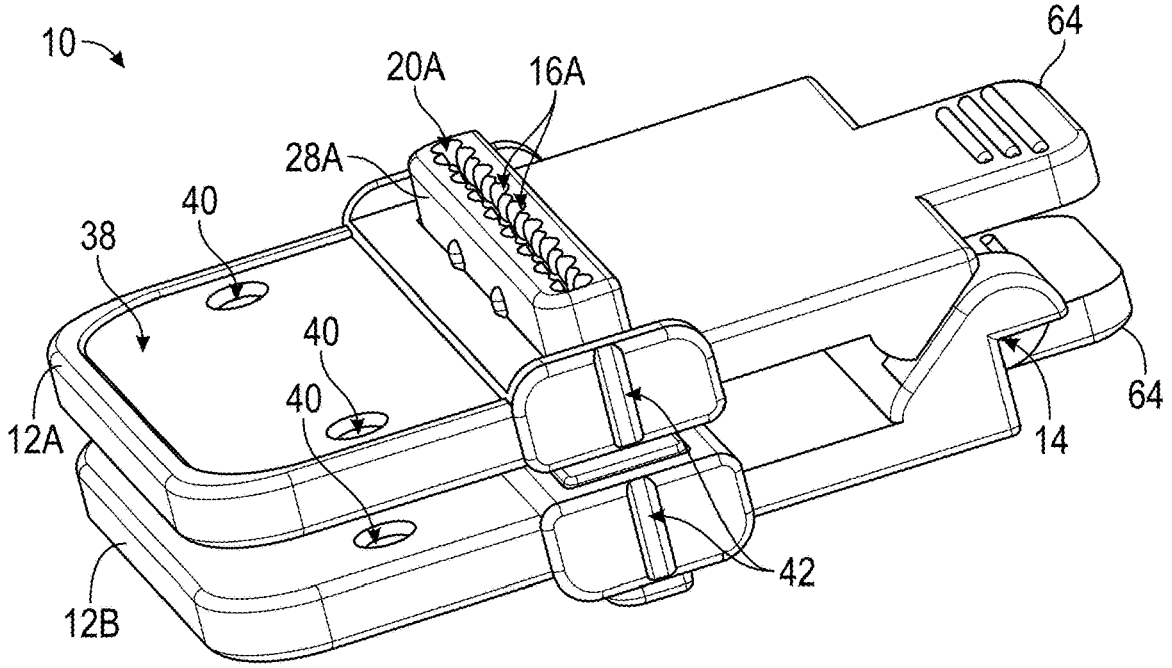
FIG. 10 shows a perspective view of a stitch guide tool in a closed position in accordance with the present disclosure.
Figure 11:
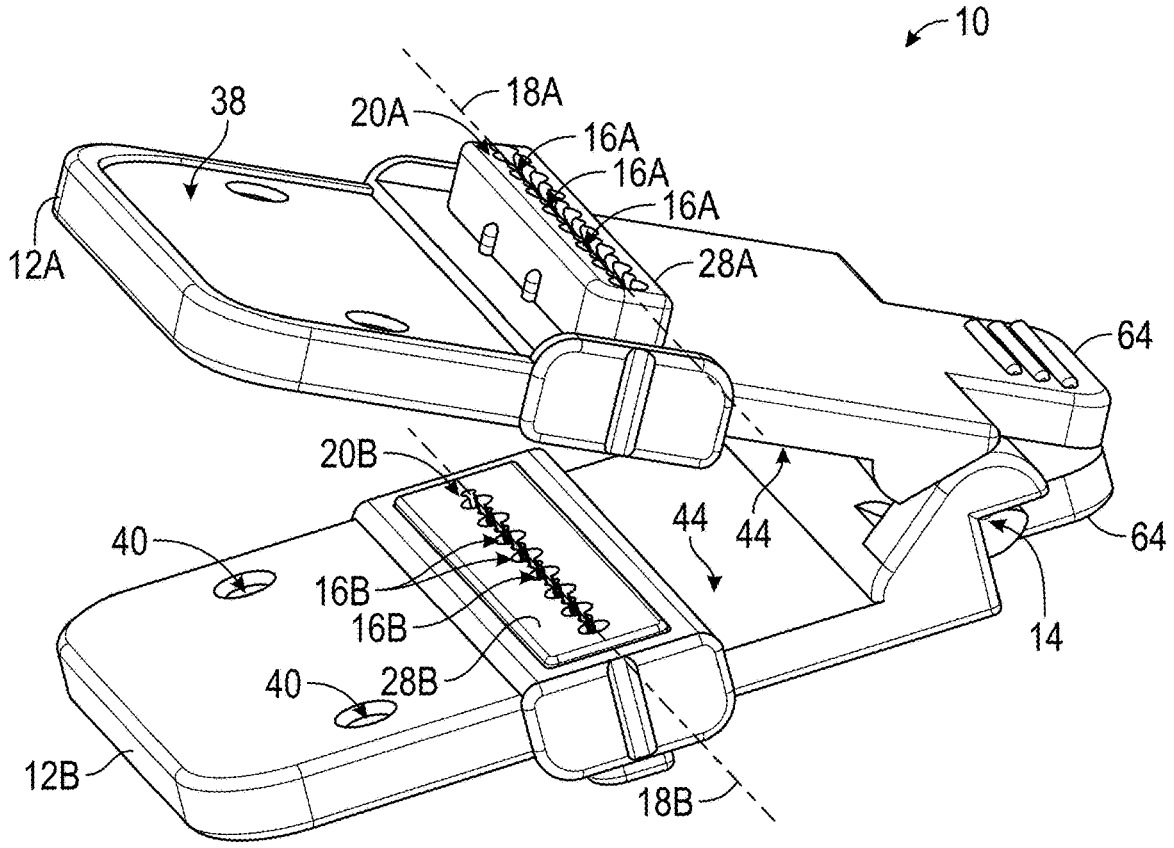
FIG. 11 shows a perspective view of a stitch guide tool in an open position in accordance with the present disclosure.

The tool 10 comprises a first plate 12A and an opposing second plate 12B. The first plate 12A and the opposing second plate 12B are configured to be retained in a generally fixed position relative to each other when the tool 10 is being used for sewing. In a preferred embodiment, as shown in FIGS. 10-15, the first plate 12A and the second plate 12B are attached to each other by a hinge 14. In this embodiment, the first plate 12A and the second plate 12B are each configured to pivot about the hinge 14 relative to each other. FIG. 10 shows the tool 10 in a generally closed position in which the plates are pivoted toward each other, and FIG. 11 shows the tool 10 in a generally open position in which the plates are pivoted away from each other. Plates 12A and 12B can be moved to the open position so that fabric 46 can be positioned between the plates, and then plates 12A and 12B can be moved to the closed position to secure the fabric 46 between the plates, as best seen in FIG. 14.

Figure 1:
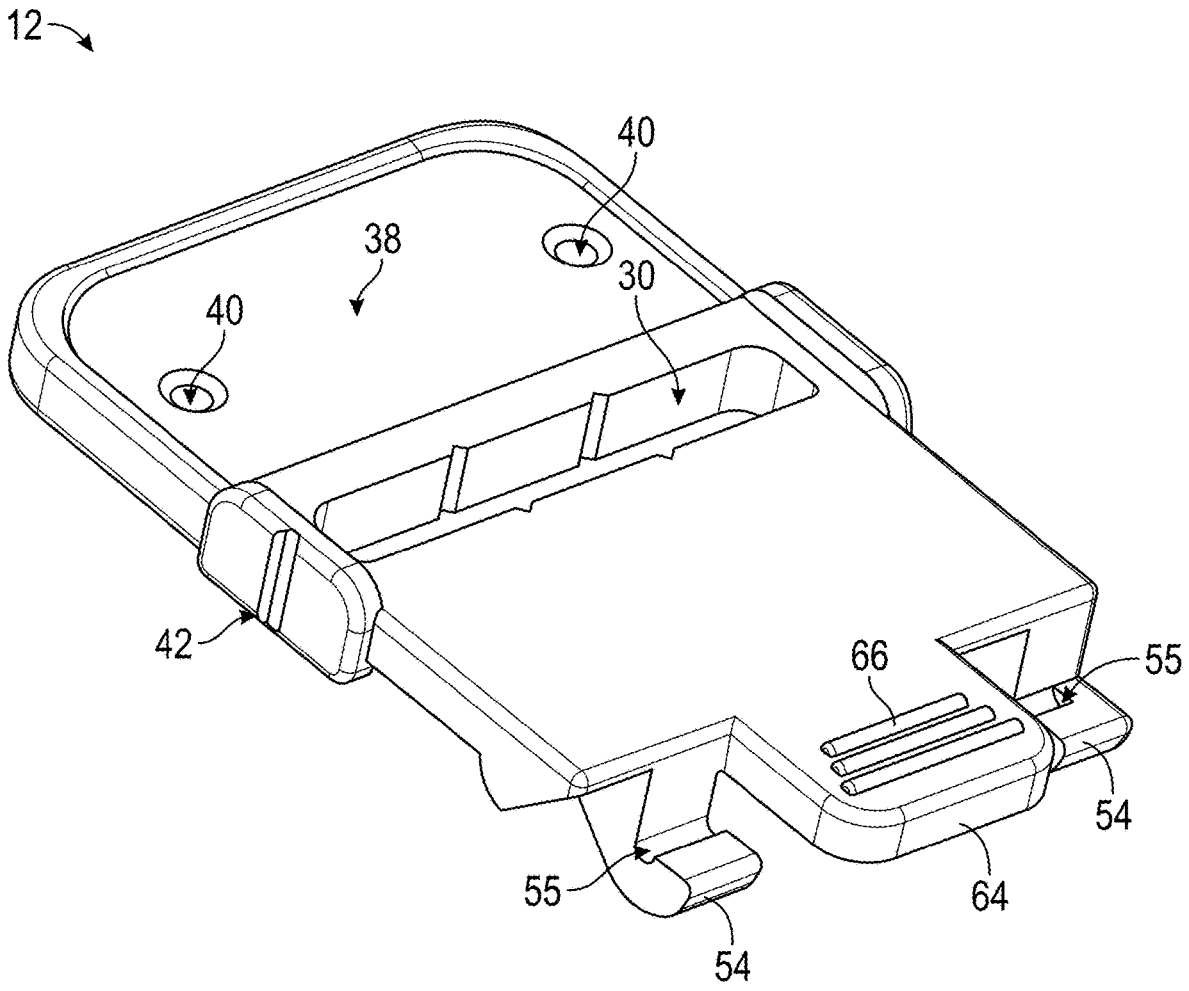
FIG. 1 shows a perspective view of a plate component of a stitch guide tool in accordance with the present disclosure.
Figure 2:
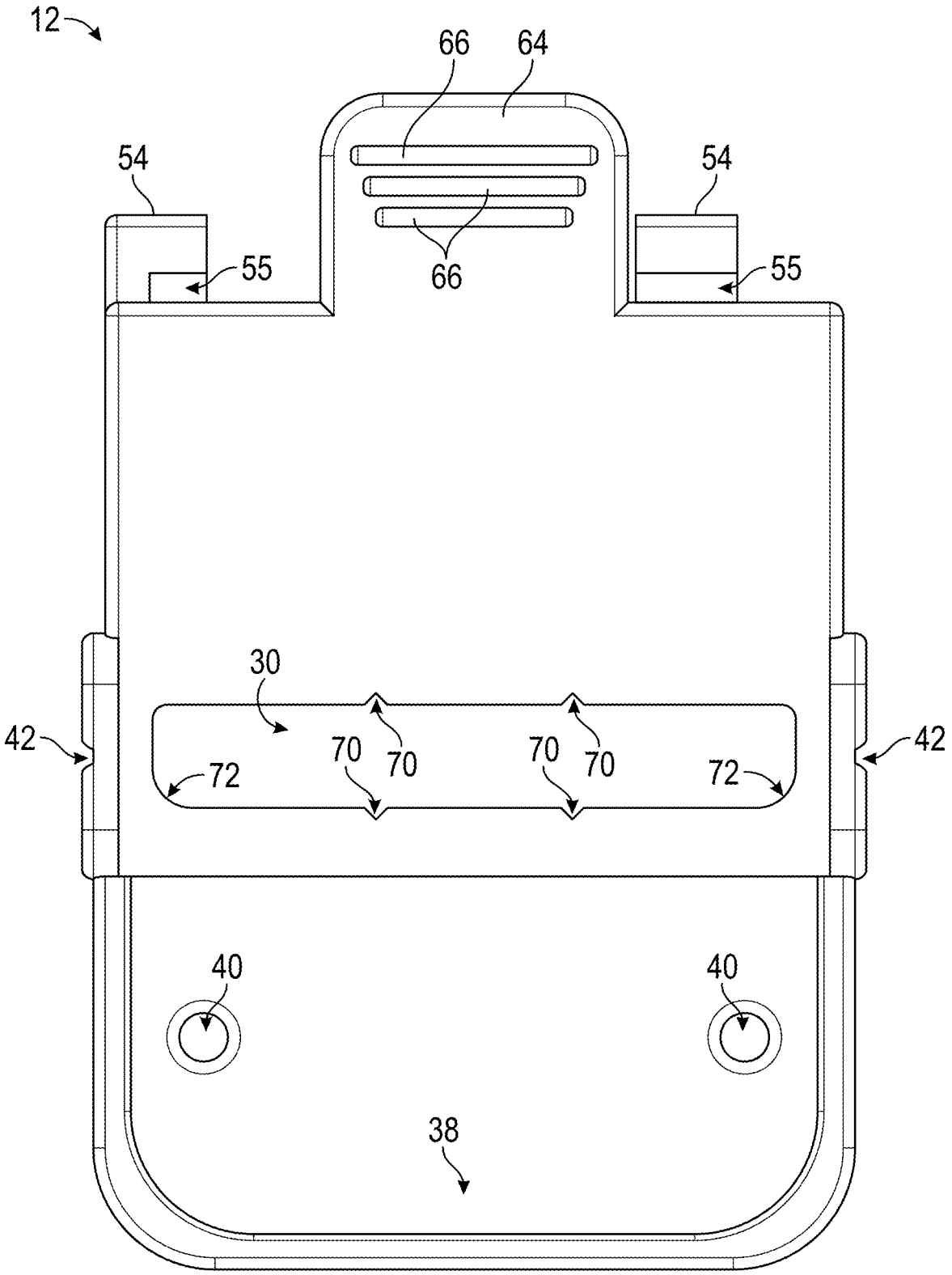
FIG. 2 shows a top plan view of a plate component of a stitch guide tool in accordance with the present disclosure.
Figure 3:
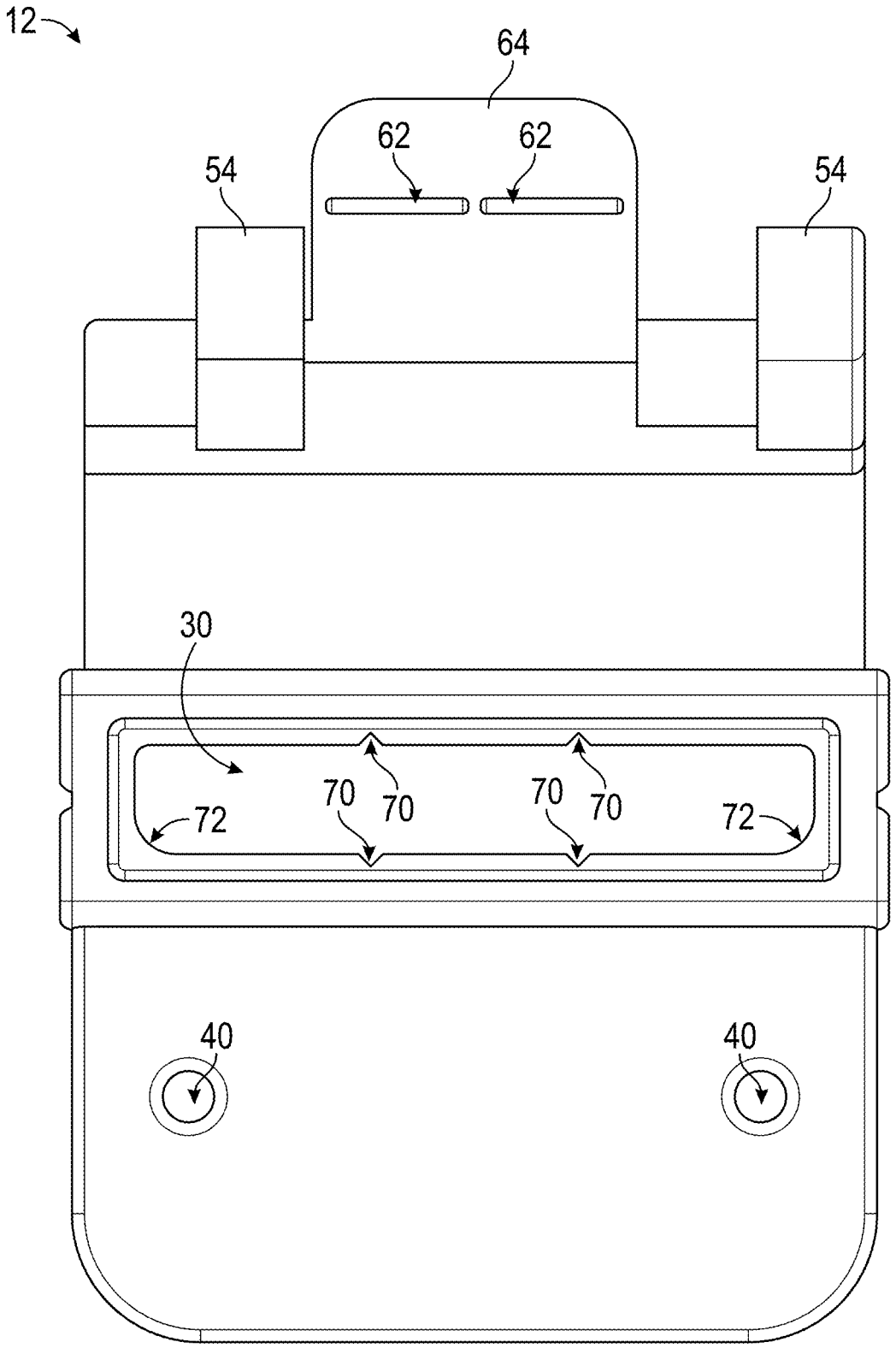
FIG. 3 shows a bottom plan view of a plate component of a stitch guide tool in accordance with the present disclosure.
Figure 4:
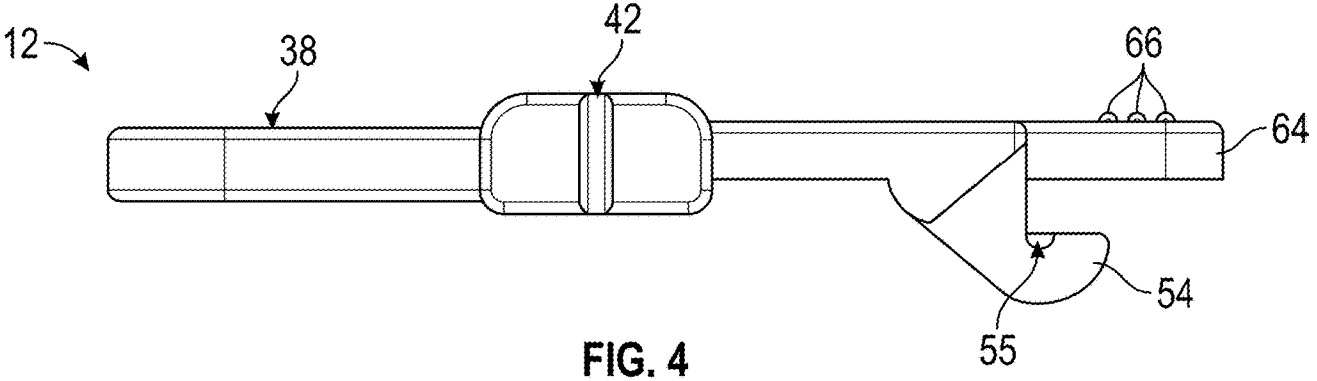
FIG. 4 shows a side elevation view of a plate component of a stitch guide tool in accordance with the present disclosure.
Figure 12:
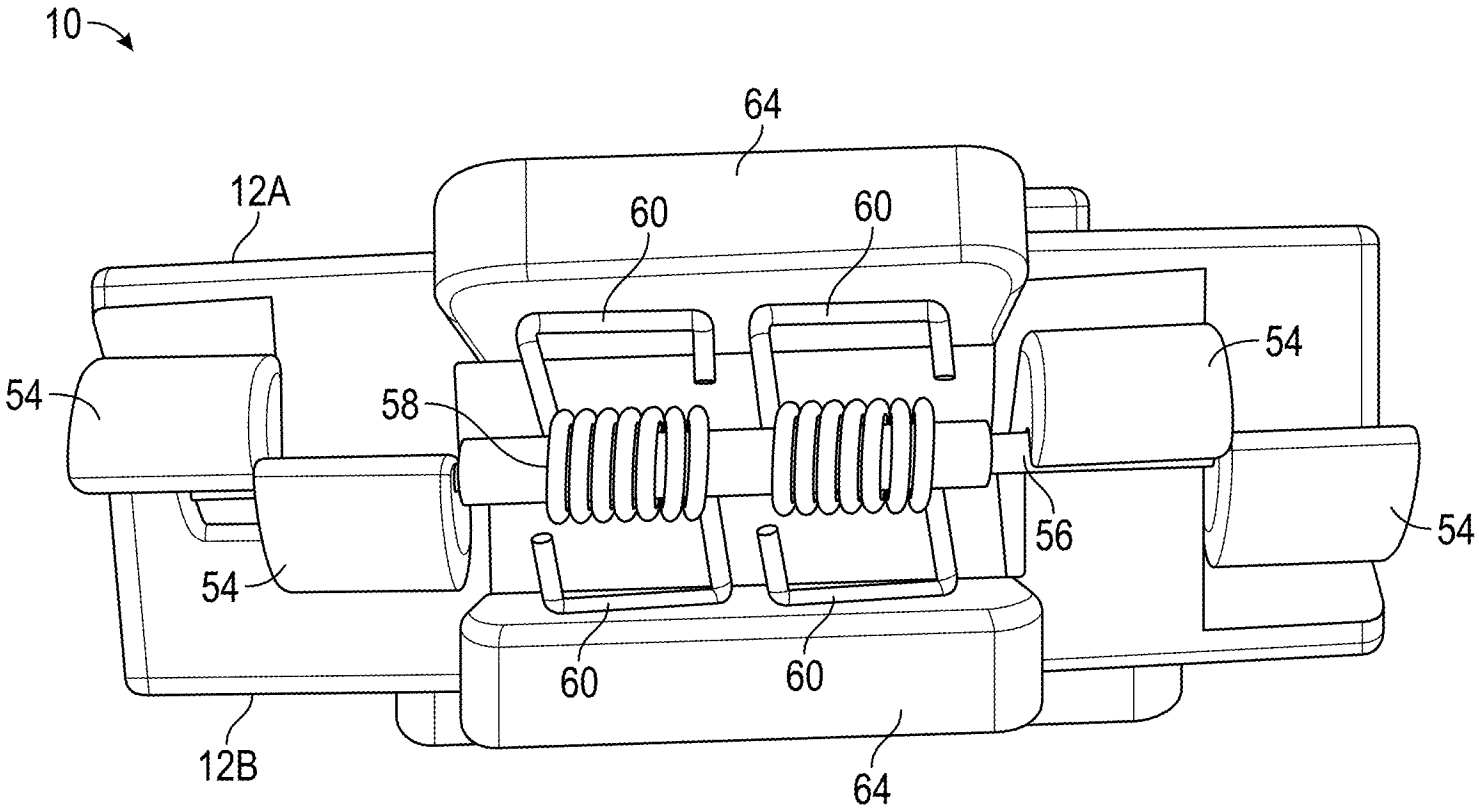
FIG. 12 shows a rear view of a stitch guide tool in accordance with the present disclosure.

In a preferred embodiment, each plate 12A, 12B is identical to the other plate, and the two plates 12A, 12B are positioned in a mirror-image fashion when attached to each other by the hinge 14. FIGS. 1-4 illustrate one of the identical plates 12 detached from the other plate. In a preferred embodiment, the plates 12A and 12B are biased toward each other so that the fabric 46 can be retained between the plates by a biasing force. In this embodiment, the hinge 14 may comprise a torsion spring 58, as best seen in FIG. 12. The torsion spring 58 is attached to a proximal end of each plate 12A, 12B and is configured to bias the plates 12A, 12B toward each other. The hinge 14 may comprise opposing hook members 54 attached to each of the plates 12A, 12B. The hinge 14 may further comprise an elongated rod 56, which may be disposed within slots 55 within each of the hook members 54. The slot 55 may terminate within an outer hook member 54, as best seen in FIG. 1, to ensure that the rod 56 cannot slide out of the slot 55. Once assembled, the plates 12 may pivot about an axis defined by the elongated rod 56, which may be disposed within one or more coils of the torsion spring 58. To this end, the spring 58 may include opposing arms 60 that contact an interior surface of each plate 12 to exert the biasing force. As shown in FIG. 3, the interior surface of each plate 12 may include one or more slots 62 in which a portion of the arms 60 may rest to retain the arms 60 in a fixed contact position on each of the plates 12. The arms 60 may contact an interior side of two opposing handles 64 that are attached to a respective one of the two plates 12A and 12B. An exterior surface of each handle 64 may have one or more ridges 66, which may function as grips to help the user grip the handles 64 for moving plates 12A and 12B between the open and closed positions. The user may contact the grips 66 on the exterior of each handle 64 and use a pinching force to pivot the plates 12 toward the open position. The user may then release the pinching force to return the plates 12 to the closed position due to the biasing force. In a preferred embodiment, the plates 12 contact each other when in the closed position.

In alternative embodiments, the plates 12 may be retained in the closed position by pressure provided by a mechanism other than a hinge 14 with a biasing spring 58 or other biasing mechanism. For instance, in some embodiments, the plates 12 may be attached by a non-biasing hinge and held together by manual force or by other suitable mechanisms, including, but not limited to, clips, clamps, magnets, or any other suitable type of fastening device. In another alternative embodiment, the plates 12 may not be attached to each other and may be fitted together with fabric 46 properly positioned between the plates 12 and then retained in a fixed position relative to each other by any suitable type of fastening device.

Figure 5:
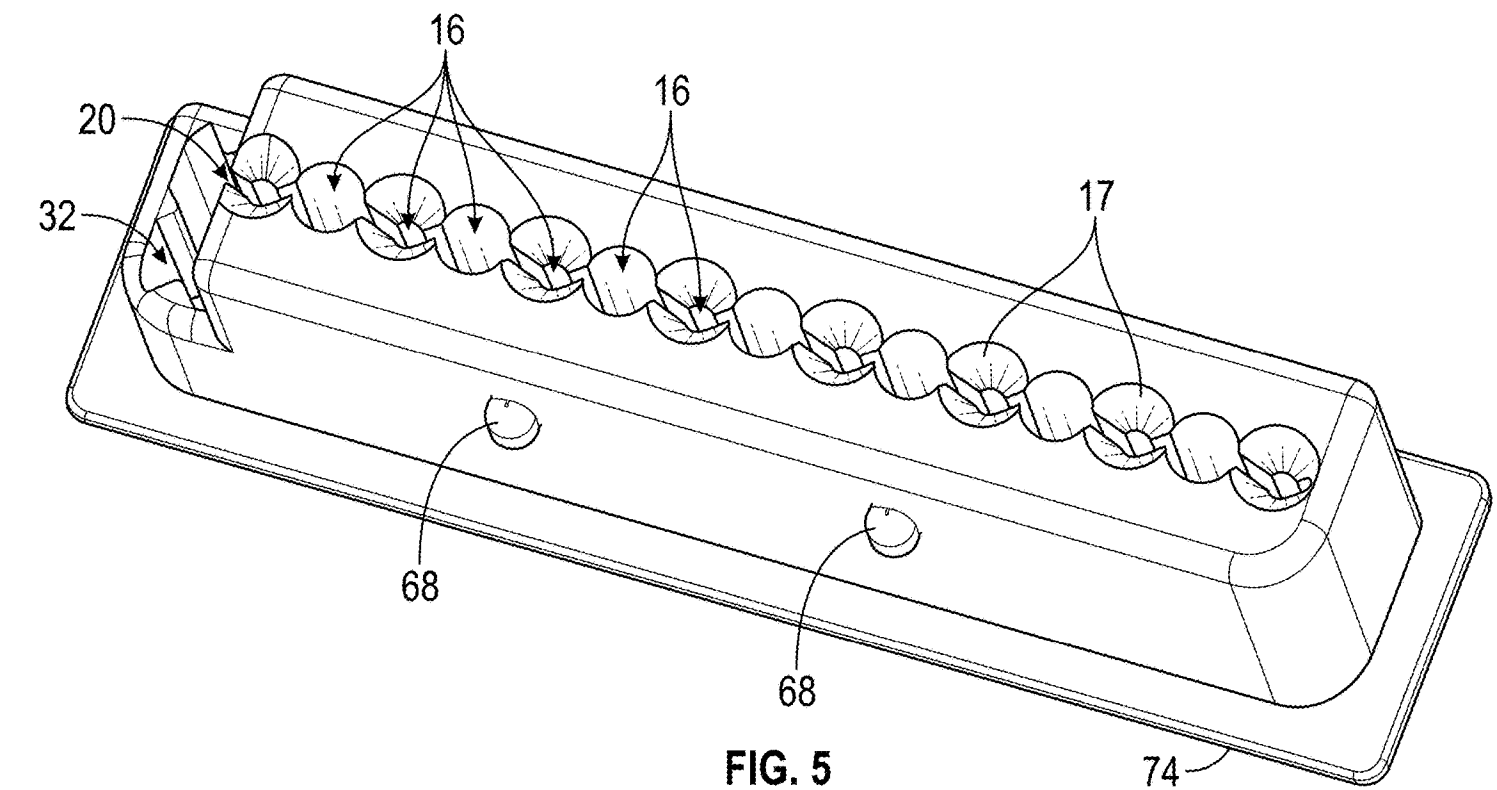
FIG. 5 shows a perspective view of a cartridge of a stitch guide tool in accordance with the present disclosure.
Figure 6:
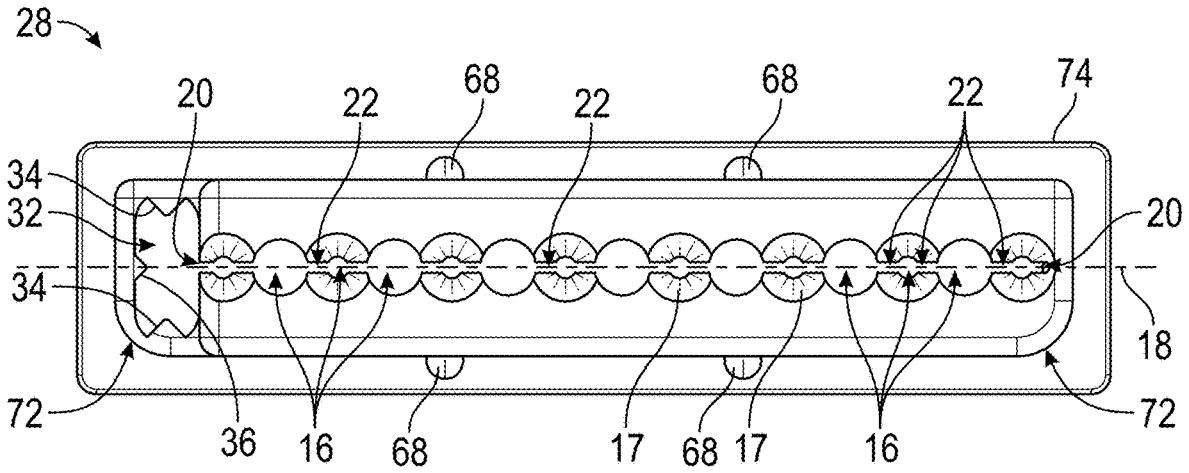
FIG. 6 shows a top plan view of a cartridge of a stitch guide tool in accordance with the present disclosure.
Figure 7:
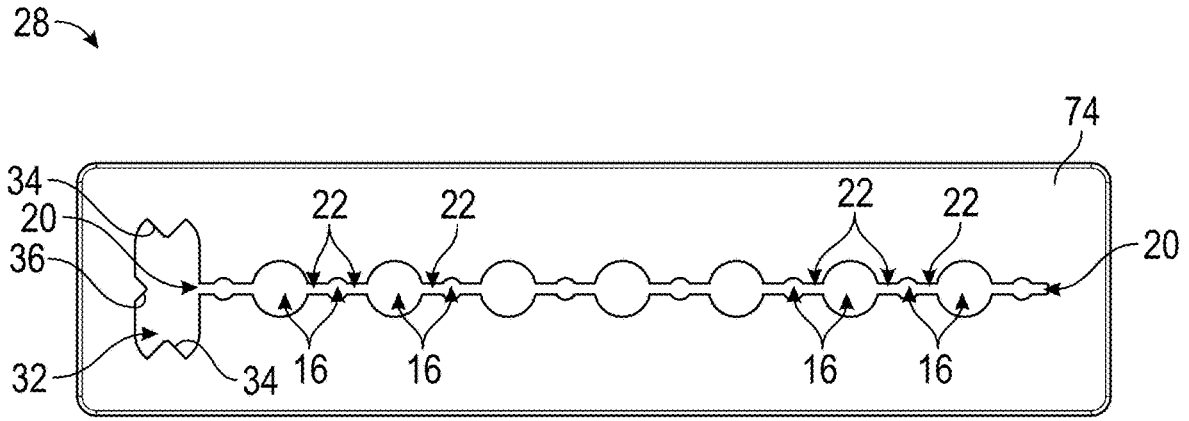
FIG. 7 shows a bottom plan view of a cartridge of a stitch guide tool in accordance with the present disclosure

As best seen in FIGS. 10 and 11, the first plate 12A has a first series of holes 16A each extending through the first plate 12A, and the second plate 12B has a second series of holes 16B extending through the second plate 12A. In one preferred embodiment, each of the two series of holes 16A and 16B are disposed within a removable cartridge 28, one of which can be secured to each respective one of the plates 12, as discussed below. FIGS. 5-7 illustrate one of the cartridges 28 showing a series of holes 16 extending through the cartridge 28 and thus through the plate 12 to which the cartridge 28 is secured when the tool 10 is in use. Because the distance between stitches 75 is determined by the distance between adjacent holes 16, the use of removable cartridges 28 allows the user to change out the cartridge 28 in order to change the width and spacing of the stitches 75 using a single tool 10. In an alternative embodiment, the holes 16 may be formed directly within each plate 12 without a removable cartridge 28.

The holes 16A of the first series of holes are aligned along a first straight line 18A, and the holes 16B of the second series of holes are aligned along a second straight line 18B. The first plate 12A has a first slot 20A extending through the first plate 12A with the first slot 20A being disposed along the first straight line 18A along which the first series of holes 16A is aligned so that the first slot 20A connects each of the holes 16A in the first series of holes. Likewise, the second plate 12B has a second slot 20B extending through the second plate 12B with the second slot 20B being disposed along the second straight line 18B along which the second series of holes 16B is aligned so that the second slot 20B connects each of the holes 16B in the second series of holes. FIGS. 6 and 7 show a top view and a bottom view, respectively, of a cartridge 28 removed from the tool 10 and best illustrate the orientation of the holes 16 of each series of holes 16A, 16B and the slot 20 each being arranged along a straight line 18 and extending entirely through the cartridge 28 and thus through the plate 12 when the cartridge 28 is installed.

In an embodiment utilizing cartridges 28, the tool 10 comprises a first cartridge 28A configured to be removably secured within a first cartridge opening 30 extending through the first plate 12A and a second cartridge 28B configured to be removably secured within a second cartridge opening 30 extending through the second plate 12B. The first series of holes 16A and the first slot 20A are disposed within the first cartridge 28A, and the second series of holes 16B and the second slot 20B are disposed within the second cartridge 28A. FIGS. 1-3 illustrate one of the plates 12 with the cartridge 28 removed to illustrate the cartridge opening 30 in which the cartridge 28 may be installed. In a preferred embodiment, as best seen in FIG. 5, each cartridge 28 has a base 74 or bottom portion and a body that extends upwardly from the base 74 in which the holes 16 and slot 20 are disposed. As best seen in FIG. 13, the body of each cartridge 28 may extend outwardly from each plate 12 to provide longitudinal depth of each individual hole 16 that extends through the cartridge 28. Each cartridge 28 may optionally include a sight opening 32 to aid in aligning the stitch 75, as discussed below.

To facilitate attachment and detachment of the cartridges 28, each cartridge 28 preferably has protrusions 68 disposed around an exterior of the cartridge 28 that correspond to indentations 70 disposed around an interior of each cartridge opening 30, as best seen in FIGS. 2 and 6. The protrusions 68 and indentations 70 are sized and positioned so that each cartridge 28 can be installed in a snap fit relation with each of the plates 12. Thus, each cartridge 28 may be inserted into each cartridge opening 30 from an interior side of the plate 12 so that each protrusion 68 is forced through the opening 30 at each indentation 70 until the protrusions 68 are positioned on an exterior side of each plate 12, as best seen in FIG. 10. In a preferred embodiment, like plates 12A and 12B, cartridges 28A and 28B are preferably identical and are positioned in a mirror-image fashion relative to each other when installed within each of the plates 12. To ensure the proper orientation of the cartridges 28, each cartridge 28 and each cartridge opening 30 preferably has keying features 72 configured so that the cartridges 28 can be installed only in the proper orientation. In a preferred embodiment, the keying features comprise correspondingly curved surfaces 72 positioned at one or more corners of the cartridge 28 and one or more corresponding corners of the cartridge opening 30.

In a preferred embodiment, as best seen in FIG. 13, when each cartridge 28 is fully inserted and installed on each plate 12, the bottom 74 of each cartridge 28 extends slightly inwardly from an inner side of each plate 12 so that the bottom 74 of cartridge 28A (installed on plate 12A) extends slightly closer to plate 12B, and vice versa, than other portions of plate 12A positioned toward the distal end of the plate relative to the hinge 14. This configuration allows the bottoms 74 of each of cartridges 28A and 28B to be the primary contact point with the fabric 46 when the fabric 46 is positioned between the plates 12, as best seen in FIG. 14. This configuration allows the two opposing plates 12 to effectively retain the fabric 46 in place at the location where the needle 50 passes through the openings 16 and thus through the fabric 46.

When the two plates 12 are brought together so that the plates 12 are positioned adjacent to each other, each respective hole 16 of the first series of holes 16A is configured to generally longitudinally align with a corresponding hole 16 of the second series of holes 16B. Each plate 12 preferably has a generally planar structure, and the holes 16 of each series may be longitudinally aligned when the plates 12 are adjacent to each other so that corresponding surfaces on sides of the planar structure of each plate 12 are brought into contact or in close proximity to each other. When the plates 12 are attached by a hinge 14, the tool 10 is designed to that the two series of holes 16A and 16B automatically align with each other when the first plate 12A and the second plate 12B are pivoted into a position in which the two plates are generally parallel to each other, as best seen in FIG. 13. FIG. 9 shows a cross section of the two opposing cartridges 28A and 28B taken along lines 18A and 18B with the tool 10 in the closed position as shown in FIG. 13. As shown in FIG. 9, each of holes 16A is longitudinally aligned with a corresponding hole 16B, except for an end hole 16 of each series, which may be aligned with an optional sight opening 32, as discussed below. In the orientation of the tool 10 shown in FIG. 13, the longitudinal alignment of holes 16A and 16B is also a vertical alignment. FIGS. 6-9 show cartridges 28 each having a total of sixteen (16) holes (including sight opening 32), though it should be understood that the number of holes 16 may be varied and still fall within the scope of the present disclosure. In a preferred embodiment, each series includes at least five holes 16, and more preferably includes at least ten holes 16.

Figure 8:
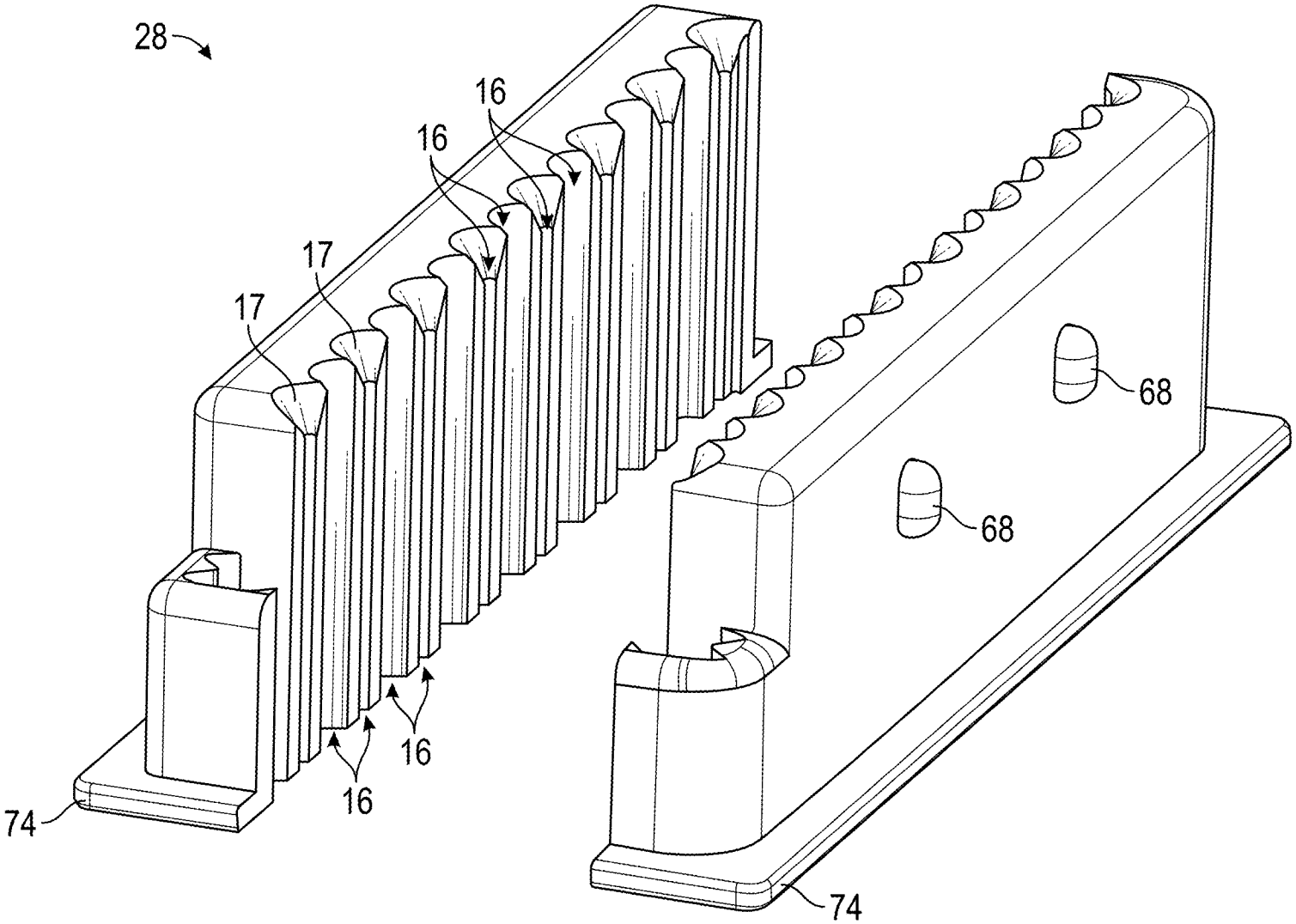
FIG. 8 shows a perspective cutaway view of a cartridge of a stitch guide tool in accordance with the present disclosure.
Figure 9:
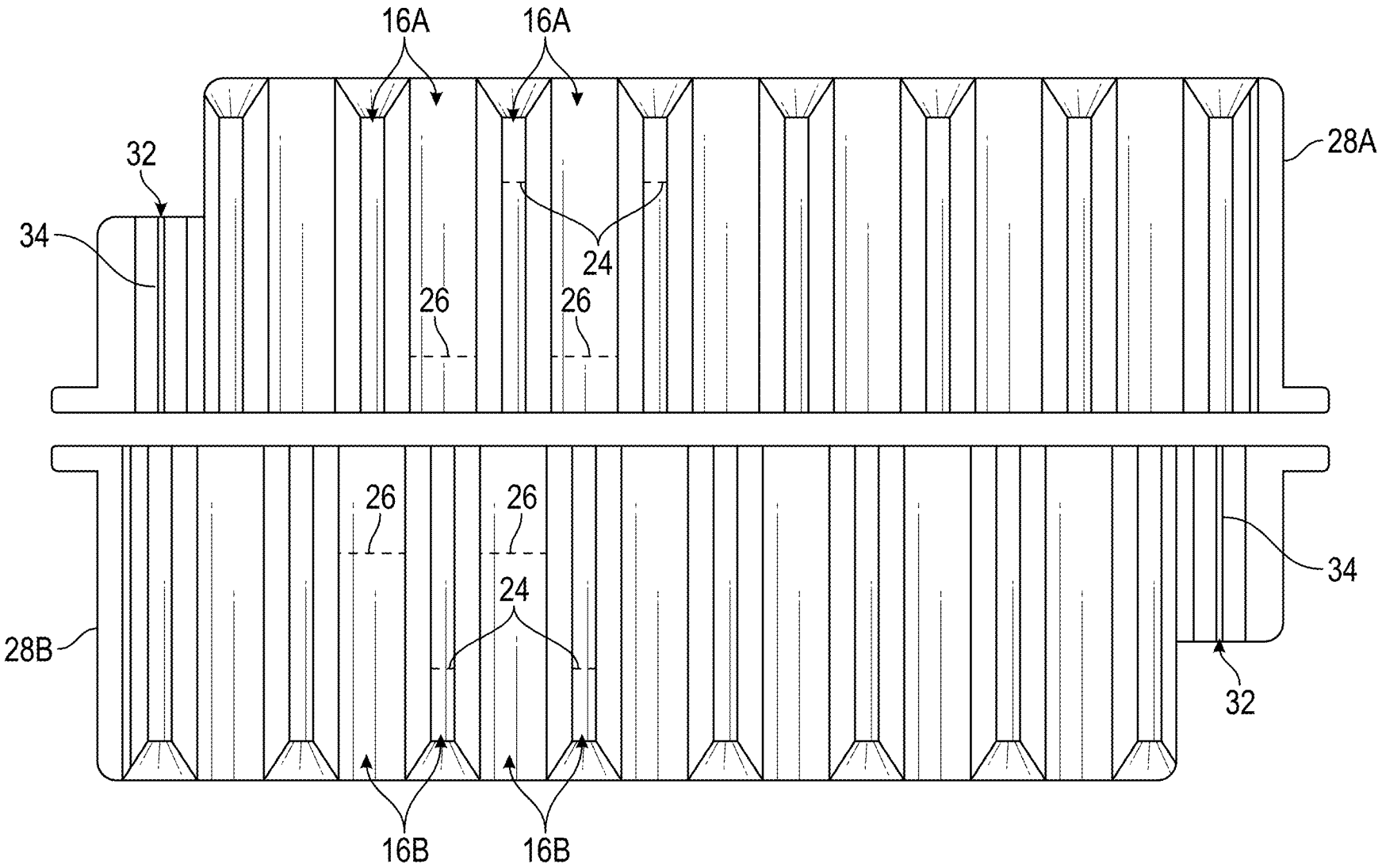
FIG. 9 shows a side cutaway view of two aligned cartridges of a stitch guide tool in accordance with the present disclosure.

As best seen in FIGS. 8 and 9, each hole 16 preferably extends longitudinally in a straight line between an open upper end and an open lower end. Thus, each hole 16 may define a longitudinally extended opening that generally extends perpendicularly to the plate 12 through which the hole 16 extends with each hole 16 being parallel to each of the other holes 16 in a series. As best seen in FIG. 6, each hole 16 in each series of holes is aligned along straight line 18, which cuts transversely across each hole 16. Each of the slots 20 is also aligned along straight line 18, and thus each slot 20 also cuts transversely across each hole 16 so that the slot 20 forms an open passageway between each hole 16 within each series of holes 16A and 16B throughout the longitudinal length of each hole 16 between its open upper end and open lower end. In a preferred embodiment, the first straight line 18A and the second straight line 18B are generally parallel to each other, and the first straight line 18A and the second straight line 18B are both positioned within a plane that is generally perpendicular to both the first plate 12A and the second plate 12B when the first plate 12A and the second plate 12B are disposed in a position in which the first plate 12A and the second plate 12B are generally parallel to each other. Thus, when the plates 12 are parallel to each other, the two slots 20A and 20B are also aligned within the plane that is perpendicular to both the first plate 12A and the second plate 12B. Each of the slots 20A and 20B are preferably also generally parallel to rod 56 and thus the axis of rotation between the plates 12.

Each of the holes 16 in both the first series 16A and the second series 16B of holes is sized to allow the sewing needle 50 to pass through the hole 16. In a preferred embodiment, however, portions 22 of each slot 20 disposed between adjacent holes 16 of each series of holes are sized so that the thread 52 can pass between those portions 22 of the slot 20 but the needle 50 cannot pass through those portions 22. Thus, these portions 22 of each slot 20 have a maximum width that is smaller than a maximum internal diameter of each hole 16, as best seen in FIGS. 6 and 7. This allows the needle 50 to be inserted through the hole 16 in an accurate position and also allows the thread 52 to pass through the portion 22 of the slot 20 between holes 16 so that the thread 52 can be pulled to the fabric 46 to create the stitch 75.

In a preferred embodiment, as best seen in FIGS. 8 and 9, the holes 16 in each series of holes 16A and 16B alternate between holes 16 of a first diameter 24 and holes 16 of a second diameter 26 that is larger than the first diameter, as indicated by dashed lines 24 and 26, which indicate an internal diameter of the holes 16. In this embodiment, holes 16 of the first diameter 24 in one series of holes (16A and 16B) align with holes 16 of the second diameter 26 in the opposing series of holes (16B and 16A, respectively). Thus, holes 16 in series 16A having the small diameter 24 longitudinally align with holes 16 in series 16B having the large diameter 26, and vice versa, as shown in FIG. 9. Holes 16 having the larger diameter 26 preferably have the same diameter 26 throughout the length of the hole 16 from the open upper end to the open lower end. As best seen in FIG. 8, holes 16 having the smaller diameter 24 preferably have a sloped entrance 17 at the open upper end, which is the location at which the needle 50 is inserted and enters into the hole 16. Beyond the sloped entrance 17, holes 16 having the smaller diameter 24 preferably have the same diameter 24 throughout the length of the hole 16 from the sloped entrance 17 to the open lower end.

In a preferred embodiment, each hole 16 with the smaller diameter 24 functions as an entrance hole into which the needle 50 is inserted, and each hole 16 with the larger diameter 26 functions as an exit hole through which the needle 50 exits the tool 10 after passing through the fabric 46. The sloped entrance 17 slopes down toward the smaller diameter 24 of the entrance hole 16, thereby providing a wider entrance point into which the user can insert the needle 50 and also a visual indicator of which holes 16 are entrance holes and which holes 16 are exit holes. This configuration of entrance holes and exit holes allows each entrance hole 16 for the needle 50 on one side of the tool 10 to be a small hole relative to the diameter of the needle 50 and each exit hole 16 for the needle 50 on the opposite side of the tool 10 to be large relative to the diameter of the needle 50. In a preferred embodiment, the small diameter 24 entrance holes 16 have an interior diameter 24 that is only slightly larger than a diameter of the needle 50 so that there is very little space surrounding the needle 50 as the needle 50 passes through the hole 16. When fabric 46 is retained between the two plates, the fabric 46 is directly adjacent to the lower open end of each of the small diameter 24 entrance holes 16 at the bottom 74 of the cartridge 28, as shown in FIG. 14. Thus, the small diameter 24 of these holes 16 helps to accurately guide the needle 50 to the proper location through which the needle 50 should pass through the fabric 46 to produce a straight stitch 75.

In a preferred embodiment, as best seen in FIG. 13, the tool 10 is configured so that there is a small gap between the bottoms 74 of opposing cartridges 28A and 28B when plates 12A and 12B are parallel to each other and thus the cartridge bottoms 74 are also parallel to each other. The tool 10 may be configured so that this gap has a width that is approximately the same as the thickness of a piece of fabric 46 that is folded over itself to create a hem formed by a stitch 75. This allows plates 12A and 12B to be generally parallel to each other when a piece of fabric 46 is retained between the plates 12. However, because the thickness of fabric 46 varies, the size of the gap between the bottom 74 of each cartridge 28 when the plates 12 are parallel is only an approximation. Thus, depending on the fabric 46 being stitched, plates 12A and 12B may not be positioned exactly parallel to each other when the plates are pressed against opposing sides of the fabric 46, and thus holes 16A may not be perfectly aligned longitudinally with holes 16B. In this case, the configuration of entrance holes 16 having a smaller diameter 24 and exit holes 16 having a larger diameter 26 provides an allowance of space for the needle 50 to enter the exit hole 16 when holes 16A and 16B are not perfectly aligned longitudinally. The needle 50 can pass through the smaller diameter 24, then through the fabric 46, and then enter the larger diameter 26 even if the entrance and exit holes 16 are not aligned exactly. The needle 50 then has space within the larger diameter 26 to pass entirely through the exit hole 16 and exit the opposite side of the tool 10.

A method of using the present stitch guide tool 10 to manually sew a stitch 75 in a piece of fabric 46 or similar type of pliable material is also provided. A length of thread 52 for creating the stitch 75 is first attached to a sewing needle 50, as shown in FIG. 15. The piece of fabric 46 is then positioned between the first plate 12A and the second plate 12B such that the piece of fabric 46 is disposed between the first series of holes 16A and the second series of holes 16B. To position the fabric 46, the plates 12 may be pivoted about the hinge 14 into the opened position, as shown in FIG. 11, and the fabric 46 may be placed between plates 12A and 12B, at which point the plates 12 may be pivoted back to the closed position in which the plates 12 are then contacting opposing sides of the fabric 46. Preferably, the bottoms 74 of cartridges 28A and 28B are the primary contact points on the fabric 46. Other portions of the opposing plates 12, which are located between the cartridge bottoms 74 and the hinge 14 and also between the cartridge bottoms 74 and a distal end of each plate 12 opposite the hinge 14, preferably do not directly contact each other when the plates 12 are brought to the closed position and thus do not pinch the piece of fabric 46 with significant force when in the closed position, as best seen in FIG. 14.

To properly position the fabric 46, the portion of the article of clothing to be hemmed, such as a leg of a pair of trousers, is typically first turned inside out and then folded onto itself as shown in FIG. 14. Folding the fabric 46 creates an end 48 of the fabric 46 that forms a bottom of a leg of the trousers or an end of a shirt sleeve after the stitch 75 is sewn. The end 48 of the fabric 46 is then disposed between the plates 12 in an area 44 between the location at which the holes 16 are positioned, which determines the position of the stitch 75, and the hinge 14. As best seen in FIG. 13, the width between these areas 44 of each plate 12 when the tool 10 is in the closed position is preferably greater than the width between other portions of the plates 12, such as the width between distal portions 38 of the plates 12 on the opposite side of each cartridge 28 from the hinge 14. Thus, the inner and outer surfaces of each plate 12 are preferably not entirely flat surfaces throughout the plate 12, though each plate 12 generally has a planar structure. The greater width between areas 44 of the opposing plates 12 may provide additional space in which the folded end 48 of the fabric 46 may be retained during use, which may be beneficial when working with thicker fabrics or when the stitch 75 is desired to be sewn farther from the folded end 48 of the fabric 46, thereby requiring more fabric 46 to be retained within this area 44.

Pressure may then be applied to the first plate 12A and the second plate 12B to retain the piece of fabric 46 in place between the first plate 12A and the second plate 12B during use. In the embodiment utilizing a biased hinge 14, pressure may be applied simply by allowing the biasing force between the first plate 12A and the second plate 12B to retain the piece of fabric 46. To ensure that the fabric 46 does not slip and thus change position relative to the plates 12 during use, additional pressure may be applied by the user manually. In a preferred embodiment, the first plate 12A includes a first gripping area 38 disposed on an opposite side of the first series of holes 16A from the hinge 14, and the second plate 12B also includes a second gripping area 38 disposed on an opposite side of the second series of holes 16B from the hinge 14. The gripping areas 38 provide opposing areas of the plates 12 at which the user may manually apply a pinching or gripping force or otherwise apply pressure to each of the two plates 12 to firmly retain the fabric 46 between the plates 12. The user may also utilize the gripping areas 38 to generally hold the tool 10 during use.

Prior to positioning the fabric 46 between the two plates 12, a line may be drawn or otherwise affixed to the fabric 46 in the location at which the stitch 75 is desired to be positioned as a visual indicator for the user during use. The fabric 46 may then be positioned between the plates 12 so that the indicator line on the fabric 46 is aligned with each of the slots 20A and 20B, which also aligns the indicator line with each series of holes 16A and 16B. Because the fabric 46 will be covered by each of the plates 12, thereby obstructing the user's view of the fabric 46, each plate 12 preferably has guide indicators 42 on each side of the plate 12. Each guide indicator 42 may comprise a groove in the edge of the plate 12, as best seen in FIG. 10, or other linear visual indicator that is aligned with the slot 20 connecting the holes 16 of the plate 12 at opposing ends of the slot 20. The two opposing guide indicators 42 on the plate 12 that is visible to the user (12A or 12B depending on the orientation of the tool 10) may be aligned on both sides of the plate 12 with the indicator line on the fabric 46 to ensure that the tool 10 is properly positioned on the fabric 46 to create the stitch 75 in exactly the desired location and to ensure that the tool 10 stays in alignment during the stitching process.

Next, once the tool 10 is installed and properly aligned on the fabric 46, the user may begin the process of using the stitch guide tool 10 to sew the stitch 75, which generally involves inserting the needle 50 and thread 52 consecutively through a hole 16 in one cartridge 28, the fabric 46, and an aligned hole 16 in the opposing cartridge 28, and then repeating the process to create the stitch 75. The user may first measure out a length of thread 52 needed for the stitch 75. The user may then pass the needle and attached thread 52 through an opening 40 within the gripping area 38 of one of the plates 12. When gripping the tool 10 at the gripping areas 38, the user may cover the opening 40 with his or her thumb to retain the thread 52 within the opening 40 to ensure that thread 52 does not inadvertently pull out of a previously sewn portion of the stitch 75 during use. The distal end 38 of each plate 12 preferably has two openings 40 on opposite sides, as best seen in FIG. 11, so that either opening 40 can be used depending on personal preference of the user, which may depend on which end of the series of holes 16 the user begins the process and on whether the user is right-handed or left-handed.

Next, to begin the process, the needle 50 with the attached thread 52 is initially inserted into an open end and then passed through one of the holes 16 of the first series of holes 16A, then through the piece of fabric 46 disposed between the plates 12, and then out through the corresponding hole 16 of the second series of holes 16B that is longitudinally aligned with the hole 16 of the first series of holes 16A through which the sewing needle 50 and thread 52 were initially inserted and passed through. In a preferred embodiment in which the holes 16 have different sized internal diameters (24 or 26), the needle 50 is initially inserted into one of the holes 16A with the smaller diameter 24 in the first series of holes 16A. For this reason, each series of holes 16 preferably has a hole 16 with a small diameter 24 positioned at an end position of at least one end of the series of holes, as best seen in FIGS. 6, 7, and 9, so that the user can begin the process at an end of the series and thus at an end of the slot 20 connecting the holes 16. Then, after the needle 50 and thread 52 pass through the fabric 46, the needle 50 enters and passes completely through the corresponding longitudinally aligned hole 16B with the larger diameter 26 in the second series of holes 16B, exiting the tool 10 on the opposite side of the tool 10 with the thread 52 extending through both the fabric 46 and both holes 16A and 16B.

Next, the needle 50 with the attached thread 52 is inserted back into an open end of an entrance hole 16 of the second series of holes 16B that is directly adjacent to the exit hole 16B of the second series of holes 16B out of which the needle 50 exited. The exit hole 16B has a large diameter 26, and the adjacent entrance hole 16B has a small diameter 24. The needle 50 with thread 52 is then passed through the adjacent entrance hole 16B, through the piece of fabric 46 a second time, and then out through the corresponding exit hole 16A of the first series of holes 16A that is longitudinally aligned with the hole 16B of the second series of holes 16B through which the sewing needle 50 and thread 52 were inserted and passed through. This creates a second pass of the needle 50 and thread 52 in the next pair of corresponding longitudinally aligned holes 16A and 16B in the two aligned rows of holes 16. When the needle 50 exits one hole 16B and then enters an adjacent hole 16B for the second pass, the thread 52 is pulled through a portion 22 of slot 20B between the two adjacent holes 16B and down to the fabric 46 to create a stitch 75 on one side of the fabric 46, as shown in FIG. 15. After the needle 50 exits the exit hole 16A, the user can make a third pass by inserting the needle 50 into an adjacent entrance hole 16A and passing the needle 50 completely through the tool 10 a third time. The thread 52 is then pulled through a portion 22 of slot 20A between the two adjacent holes 16A and down to the fabric 46 to create a stitch 75 on the opposite side of the fabric 46. This process can then be repeated along the entire series of holes 16A and 16B from one end of each slot 20 to the opposite end of the slot 20 to create a running stitch 75 with the distance between individual stitches on one side of the fabric 46 being determined by the distance between adjacent holes 16.

Once the needle 50 has been passed through all of the pairs of longitudinally aligned holes 16 from one end of the slot 20 to the opposite end of the slot 20, the user may then pivot the plates 12 slightly apart from each other and slide the tool 10 along the fabric 46 to reposition the tool 10 farther along the desired path of the hem. As the tool 10 slides along the path, the portion of the thread 52 that is attached the needle 50 and extends between the needle 50 and the tool 10, as shown in FIG. 15, will pass through the slot 20 from its current position back to the opposite end of the slot 20 where the process was initially begun. The thread 52 may be passed through the slot 20 until the thread 52 is positioned within one of the large diameter 26 exit holes 16. The tool 10 may then be realigned to maintain alignment with the desired path of the hem. The user may then restart the process to continue the running stitch 75 by inserting the needle 50 into a small diameter 24 entrance hole 16 adjacent to the exit hole in which the thread 52 is now positioned. This process of consecutively passing the needle 50 and thread 52 through each pair of corresponding holes 16 and then sliding the tool 10 back to its starting point may be repeated until the stitch 75 is completed. Alternatively, once the needle 50 has been passed through all of the pairs of longitudinally aligned holes 16 from one end of the slot 20 to the opposite end of the slot 20, the user may then begin to work backwards by inserting the needle 50 back into the entrance hole 16 adjacent to the final exit hole 16 and then repeating the process to get back to the original starting point. By doing this, the user may use the tool 10 to create a full stitch rather than a running stitch 75. The tool 10 may then be moved to the end of the full stitch and realigned to repeat the process to continue creating a full stitch.

In a preferred embodiment, each plate 12A and 12B may optionally include a sight opening 32 that is disposed at an end of the slot 20A and 20B connecting the series of holes 16A and 16B. As best seen in FIGS. 6 and 7, in a preferred embodiment utilizing cartridges 28, the sight opening 32 is disposed within the cartridge 28, though the embodiments illustrated in FIGS. 10-11 and 15 utilize cartridges 28 that do not include the optional sight openings 32. The slot 20 extends to the sight opening 32 so that the sight opening 32 is connected to the slot 20 and each hole 16 in the series of holes are connected to each other by the slot 20. The sight opening 32 is thus also aligned with the holes 16 along a straight line 18. The sight opening 32 is essentially an additional hole 16 in the series of holes, but it has a larger size than any of the holes 16 to allow the user to look into the opening 32 and see the position at which the thread 52 exits the fabric 46. To make it easier for the user to see into the sight opening 32, the upper open end of each opening 32 is preferably closer to the fabric 46 than the upper open ends of the holes 16, as best seen in FIG. 9.

As best seen in FIGS. 6 and 7, the sight opening 32 of each cartridge 28A and 28B is directly adjacent to one of the holes 16 having a small diameter 24. When starting the sewing process by initially inserting the needle 50 through a hole 16 with a small diameter 24, the user may start with the small hole 16 directly adjacent to the sight opening 32. The user may then continue the process through adjacent holes 16 moving away from the sight opening 32. When the user passes the needle 50 out of the final large exit hole 16 in the series that is on the same side of the tool 10 that the user can see, the user may then slide the tool 10 so that the thread 52 between the needle 50 and the tool 10 passes through the slot 20 all the way to the sight opening 32 before restarting the process to continue the stitch 75. In the orientation shown in FIG. 6, the user may pass the needle 50 out of the large exit hole 16 that is the penultimate hole 16 of the series on the end opposite the sight opening 32. The last hole 16 of the series, which is a small entrance hole 16, may optionally be utilized for inserting a registration pin (not shown). The registration pin may be a sewing needle 50 with a stopper attached to an end of the needle 50 that is opposite the pointed end of the needle 50. The registration pin does not have thread 52 attached to it. The stopper may be sized to fit within one of the holes 16 so that the registration pin cannot be passed through the hole 16. The registration pin may be inserted into the final hole 16 in the series opposite the sight opening 32 and through the fabric 46 when aligning the tool 10 in the proper location for the stitch 75. The registration pin may aid in retaining the tool 10 in the proper position as the user works through the process. This may be beneficial when working across an intersecting seam of an article of clothing, which may be thicker than the rest of the fabric 46 and thus may make it more difficult to maintain proper positioning while working. In an alternative embodiment, the cartridges 28 or plates 12 may have one or more additional aligned openings extending through the cartridges 28 or plates 12 that are outside of the sewing slots 20 so that one or more registration pins may be inserted through a respective one of these openings in the cartridges 28 or plates 12 outside of the sewing slot 20, which allows the registration pins to maintain proper positioning of the tool 10 without impeding the stitching process.

In a preferred embodiment, as best seen in FIGS. 6 and 7, each sight opening 32 has an alignment protrusion 34 that extends into the sight opening 32 and is disposed at a centered position of the sight opening 32. The sight opening 32 preferably has two alignment protrusions 34 disposed on opposing sides of the opening 32. After the user slides the tool 10 so that the thread 52 is extending out of the sight opening 32, the thread 52 may be centered within the opening 32 by aligning the thread 52 directly between the two alignment protrusions 34. The opening 32 preferably has an additional alignment protrusion 36 that is aligned with the slot 20 to facilitate centering the thread 52 within the opening 32. Once the thread 52 is centered, the user may then begin the process again by inserting the needle 50 into the small entrance hole 16 directly adjacent to the sight opening 32. By accurately centering the thread 52 within the sight opening 32, the user can accurately maintain the stitch 75 spacing after sliding the tool 10 to restart the process to continue the stitch 75. In one embodiment, the cartridges 28 may have sight openings 32 at both ends of the slots 20 rather than at just one end. This may give the user the option of working from right to left or from left to right, which may make the tool 10 easier to use for both right-handed and left-handed users.

It will be appreciated that the configurations and methods shown and described herein are illustrative only, and that these specific examples are not to be considered in a limiting sense, because numerous variations are possible. The subject matter of the present disclosure includes all novel and non-obvious combinations and sub-combinations of the various systems and configurations, and other features, functions, and/or properties disclosed herein. It is understood that versions of the invention may come in different forms and embodiments. Additionally, it is understood that one of skill in the art would appreciate these various forms and embodiments as falling within the scope of the invention as disclosed herein.

What is claimed is:

1. A stitch guide tool comprising:

a first plate and an opposing second plate attached to the first plate by a hinge, wherein the first plate and second plate are each configured to pivot about the hinge relative to each other;

a first series of holes each extending through the first plate, wherein the holes of the first series of holes are aligned along a first straight line;

a first slot extending through the first plate, wherein the first slot is disposed along the first straight line along which the first series of holes is aligned so that the first slot connects each of the holes in the first series of holes;

a second series of holes each extending through the second plate, wherein the holes of the second series of holes are aligned along a second straight line; and a second slot extending through the second plate, wherein the second slot is disposed along the second straight line along which the second series of holes is aligned so that the second slot connects each of the holes in the second series of holes, wherein each respective hole of the first series of holes is generally longitudinally aligned with a corresponding hole of the second series of holes when the first plate and the second plate are disposed in a position in which the first plate and the second plate are generally parallel to each other, and wherein the first straight line and the second straight line are generally parallel to each other, and wherein the first straight line and the second straight line are both positioned within a plane that is generally perpendicular to both the first plate and the second plate when the first plate and the second plate are disposed in a position in which the first plate and the second plate are generally parallel to each other.

2. The tool of claim 1, wherein the first plate and the second plate are biased toward each other.

3. The tool of claim 1, wherein the first plate and the second plate pivot about an axis defined by an elongated rod, wherein the slot in each plate is generally parallel to the rod.

4. The tool of claim 1, wherein each of the holes in the first series of holes is sized to allow a sewing needle to pass through the hole, wherein portions of the first slot disposed between adjacent holes of the first series of holes is sized so that the sewing needle cannot pass through the portions of the first slot disposed between the adjacent holes of the first series of holes, and wherein each of the holes in the second series of holes is sized to allow the sewing needle to pass through the hole, wherein portions of the second slot disposed between adjacent holes of the second series of holes is sized so that the sewing needle cannot pass through the portions of the second slot disposed between the adjacent holes of the second series of holes.

5. The tool of claim 1, wherein the holes in the first series of holes alternate between holes of a first diameter and holes of a second diameter that is larger than the first diameter, and wherein the holes in the second series of holes also alternate between holes of the first diameter and holes of the second diameter.

6. The tool of claim 5, wherein each hole of the first series of holes that has the first diameter is longitudinally aligned with a corresponding hole of the second series of holes that has the second diameter, and wherein each hole of the second series of holes that has the first diameter is longitudinally aligned with a corresponding hole of the first series of holes that has the second diameter.

7. The tool of claim 1, further comprising a first cartridge configured to be removably secured within a first cartridge opening extending through the first plate and a second cartridge configured to be removably secured within a second cartridge opening extending through the second plate, wherein the first series of holes and the first slot are disposed within the first cartridge, and wherein the second series of holes and the second slot are disposed within the second cartridge.

8. The tool of claim 1, wherein the first plate has a first sight opening that is disposed at an end of the first slot and is connected to the first slot, wherein the first sight opening is aligned with the holes of the first series of holes along the first straight line, wherein the second plate has a second sight opening that is disposed at an end of the second slot and is connected to the second slot, wherein the second sight opening is aligned with the holes of the second series of holes along the second straight line, wherein each of the first and second sight openings has an alignment protrusion that extends into the sight opening and is disposed at a centered position of the sight opening.

9. The tool of claim 1, wherein the first plate includes a first gripping area disposed on an opposite side of the first series of holes from the hinge, and wherein the second plate includes a second gripping area disposed on an opposite side of the second series of holes from the hinge.

10. A stitch guide tool comprising:

a first plate and an opposing second plate, wherein the first plate and second plate are configured to be retained in a fixed position relative to each other;

a first series of holes each extending through the first plate, wherein the holes of the first series of holes are aligned along a first straight line;

a first slot extending through the first plate, wherein the first slot is disposed along the first straight line along which the first series of holes is aligned so that the first slot connects each of the holes in the first series of holes;

a second series of holes each extending through the second plate, wherein the holes of the second series of holes are aligned along a second straight line; and a second slot extending through the second plate, wherein the second slot is disposed along the second straight line along which the second series of holes is aligned so that the second slot connects each of the holes in the second series of holes, and wherein each respective hole of the first series of holes is configured to longitudinally align with a corresponding hole of the second series of holes when the first plate and the second plate are positioned adjacent to each other, and wherein the first straight line and the second straight line are generally parallel to each other, and wherein the first straight line and the second straight line are both positioned within a plane that is generally perpendicular to both the first plate and the second plate when the first plate and the second plate are disposed in a position in which the first plate and the second plate are generally parallel to each other.

11. The tool of claim 10, wherein each of the holes in the first series of holes is sized to allow a sewing needle to pass through the hole, wherein portions of the first slot disposed between adjacent holes of the first series of holes is sized so that the sewing needle cannot pass through the portions of the first slot disposed between the adjacent holes of the first series of holes, and wherein each of the holes in the second series of holes is sized to allow the sewing needle to pass through the hole, wherein portions of the second slot disposed between adjacent holes of the second series of holes is sized so that the sewing needle cannot pass through the portions of the second slot disposed between the adjacent holes of the second series of holes.

12. The tool of claim 10, wherein the holes in the first series of holes alternate between holes of a first diameter and holes of a second diameter that is larger than the first diameter, and wherein the holes in the second series of holes also alternate between holes of the first diameter and holes of the second diameter.

13. The tool of claim 12, wherein each hole of the first series of holes that has the first diameter is longitudinally aligned with a corresponding hole of the second series of holes that has the second diameter, and wherein each hole of the second series of holes that has the first diameter is longitudinally aligned with a corresponding hole of the first series of holes that has the second diameter.

14. The tool of claim 10, further comprising a first cartridge configured to be removably secured within a first cartridge opening extending through the first plate and a second cartridge configured to be removably secured within a second cartridge opening extending through the second plate, wherein the first series of holes and the first slot are disposed within the first cartridge, and wherein the second series of holes and the second slot are disposed within the second cartridge.

15. The tool of claim 10, wherein the first plate has a first sight opening that is disposed at an end of the first slot and is connected to the first slot, wherein the first sight opening is aligned with the holes of the first series of holes along the first straight line, wherein the second plate has a second sight opening that is disposed at an end of the second slot and is connected to the second slot, wherein the second sight opening is aligned with the holes of the second series of holes along the second straight line, wherein each of the first and second sight openings has an alignment protrusion that extends into the sight opening and is disposed at a centered position of the sight opening.

16. A method of stitching, said method comprising the steps of: providing a stitch guide tool comprising:

a first plate and an opposing second plate attached to the first plate by a hinge, wherein the first plate and second plate are each configured to pivot about the hinge relative to each other, a first series of holes each extending through the first plate, wherein the holes of the first series of holes are aligned along a first straight line, a first slot extending through the first plate, wherein the first slot is disposed along the first straight line along which the first series of holes is aligned so that the first slot connects each of the holes in the first series of holes, a second series of holes each extending through the second plate, wherein the holes of the second series of holes are aligned along a second straight line; and a second slot extending through the second plate, wherein the second slot is disposed along the second straight line along which the second series of holes is aligned so that the second slot connects each of the holes in the second series of holes, wherein each respective hole of the first series of holes is generally longitudinally aligned with a corresponding hole of the second series of holes when the first plate and the second plate are disposed in a position in which the first plate and the second plate are generally parallel to each other, and wherein the first straight line and the second straight line are generally parallel to each other, and wherein the first straight line and the second straight line are both positioned within a plane that is generally perpendicular to both the first plate and the second plate when the first plate and the second plate are disposed in a position in which the first plate and the second plate are generally parallel to each other;

positioning a piece of fabric between the first plate and the second plate such that the piece of fabric is disposed between the first series of holes and the second series of holes;

applying pressure to the first plate and the second plate to retain the piece of fabric in place between the first plate and the second plate;

attaching a length of thread to a sewing needle;

passing the sewing needle and thread through one of the holes of the first series of holes, through the piece of fabric, and then out through the corresponding hole of the second series of holes that is longitudinally aligned with the hole of the first series of holes through which the sewing needle and thread have been passed;

then passing the sewing needle and thread through an adjacent hole of the second series of holes, through the piece of fabric, and then out through the corresponding hole of the first series of holes that is longitudinally aligned with the hole of the second series of holes through which the sewing needle and thread have been passed; and then repeating the previous two steps to create a stitch in the piece of fabric.

17. The method of claim 16, wherein the first plate and the second plate are biased toward each other, wherein the step of applying pressure to retain the piece of fabric in place between the first plate and the second plate comprises allowing a biasing force between the first plate and the second plate to retain the piece of fabric.

18. The method of claim 16, wherein the first plate includes a first gripping area disposed on an opposite side of the first series of holes from the hinge, and wherein the second plate includes a second gripping area disposed on an opposite side of the second series of holes from the hinge, wherein the step of applying pressure to retain the piece of fabric in place between the first plate and the second plate comprises a user gripping the first gripping area and the second gripping area and manually applying pressure to both the first and second plates to retain the piece of fabric.

19. The method of claim 16, wherein the holes in the first series of holes alternate between holes of a first diameter and holes of a second diameter that is larger than the first diameter, and wherein the holes in the second series of holes also alternate between holes of the first diameter and holes of the second diameter, wherein each hole of the first series of holes that has the first diameter is longitudinally aligned with a corresponding hole of the second series of holes that has the second diameter, and wherein each hole of the second series of holes that has the first diameter is longitudinally aligned with a corresponding hole of the first series of holes that has the second diameter, and wherein the step of passing the sewing needle and thread through one of the holes of the first series of holes, through the piece of fabric, and then out through the corresponding hole of the second series of holes comprises first inserting the needle into one of the holes of the first series of holes that has the first diameter and then pushing the needle out of one of the holes of the second series of holes that has the second diameter.

* * * * *